United States Patent [19]

MacMurdo

[11] 3,964,746

[45] June 22, 1976

[54] MAGNETIC GAME DEVICE

[76] Inventor: Ronald L. MacMurdo, 931 Southern Artery, Quincy, Mass. 02169

[22] Filed: June 9, 1975

[21] Appl. No.: 584,864

[52] U.S. Cl. ..... 273/108; 46/238; 273/1 M

[51] Int. Cl.[2] ..... A63F 9/00

[58] Field of Search ..... 273/108, 1 M, 86 B; 46/238, 239

[56] References Cited

UNITED STATES PATENTS

| | | | |
|---|---|---|---|
| 1,988,071 | 1/1935 | Bryn | 273/1 M UX |
| 2,853,830 | 9/1958 | Herzog | 46/239 X |
| 3,195,894 | 7/1965 | Alsaker et al. | 273/86 B X |

FOREIGN PATENTS OR APPLICATIONS

| | | | |
|---|---|---|---|
| 263,833 | 9/1913 | Germany | 273/1 M |
| 18,841 | 1894 | United Kingdom | 46/238 |

*Primary Examiner*—Anton O. Oechsle
*Attorney, Agent, or Firm*—Morse, Altman, Oates & Bello

[57] ABSTRACT

A magnetic game device comprises a game board composed of a non-magnetic material and a pair of playing pieces that magnetically cooperate with one another. The game board is formed with a U-shaped channel for slidably receiving one of the playing pieces. The other playing piece is maneuvered near the one playing piece in the channel for moving the one playing piece along the channel without having the playing pieces contact one another.

9 Claims, 6 Drawing Figures

MAGNETIC GAME DEVICE

BACKGROUND OF THE INVENTION

1. Field of the Invention

The present invention relates to magnetic game devices and, more particularly, is directed towards a magnetic game device for determining the skill of an individual player.

2. Description of the Prior Art

Generally, magnetic game devices include at least a pair of magnetic elements that are manipulated by two or more players. These games, which match the skill of one player against another, have been introduced with varying degrees of success.

SUMMARY OF THE INVENTION

It is an object of the present invention to provide a magnetic game device for determining the skill of an individual player. The magnetic game device comprises a non-magnetic game board and a pair of playing pieces that magnetically cooperate with one another. The game board is formed with a U-shaped channel that is adapted to slidably receive one of the playing pieces. An individual player maneuvers the other playing piece near the one playing piece in the channel in order to move the one playing piece along the channel without actual contact of the two playing pieces. Indicia are provided on the game board to indicate the distance that the one playing piece has traveled in the channel without actual contact with the other playing piece.

Other and further objects of the present invention will in part be obvious and will in part appear hereinafter.

The invention accordingly comprises the machine possessing the construction, combination of elements, and arrangement of parts that are exemplified in the following detailed disclosure, the scope of which will be indicated in the appended claims.

BRIEF DESCRIPTION OF THE DRAWINGS

For a fuller understanding of the nature and objects of the present invention, reference should be had to the following detailed description taken in connection with the drawings wherein.

DETAILED DESCRIPTION OF THE PREFERRED EMBODIMENTS

Figure 2:
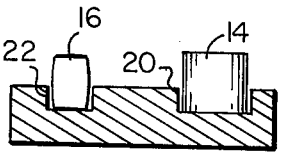
FIG. 2 is a cross-section taken along the lines 2—2 in FIG. 1.
Figure 1:
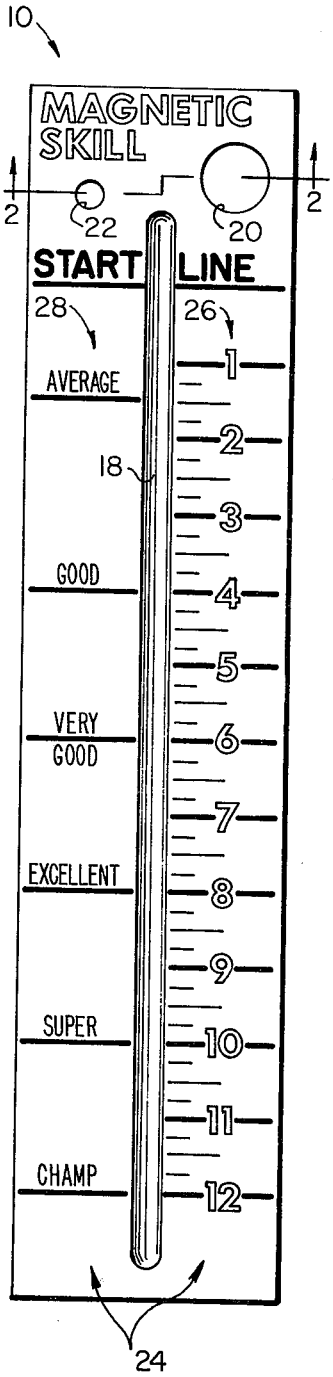
FIG. 1 is a plan view of a magnetic game device embodying the invention.
Figure 3:
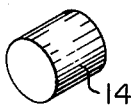
FIG. 3 is a perspective view of one playing piece.
Figure 4:
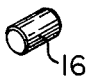
FIG. 4 is a perspective view of the other playing piece.

Referring now to the drawings, particularly FIGS. 1 and 2, there is shown a magnetic skill game device 10 embodying the present invention. Game 10 comprises a game board 12 and playing elements 14, 16. Game board 12 is formed with a longitudinally extending channel 18 having a substantially U-shaped profile in right cross section. At the upper right and left margins of game board 12, as viewed in FIG. 1, there are formed holes 20 and 22, respectively, which define holders for playing elements 14, 16.

In the illustrated embodiment, by way of example, game board 12 is a substantially rectangular member that is approximately 16 inches long, 3½ inches wide and ¾ of an inch thick. Channel 18, which defines a guide or track having a semi-circular profile in right cross section, is approximately 14 inches long and ⅜ of an inch wide at the face of board 12. Holder 20 is approximately fifteen-sixteenths of an inch in diameter and one-half of an inch deep. Holder 22 is approximately seven-sixteenths of an inch in diameter and one-half of an inch deep. Game board 12 is composed of a natural or synthetic material, for example a wood-like material such as wood, a metal such as aluminum or a polymer such as polystyrene foam, an acrylic resin, or methyl methacrylate.

Elements 14 and 16 are a pair of magnetically cooperating playing pieces, typically a magnetic member and a magnetically responsive member that are adapted for engagement and disengagement with one another. In the illustrated embodiment, by way of example, element 14 is composed of a magnetized material and element 16 is composed of a magnetically responsive material. Element 14, for example a magnet, is a substantially cylindrical member having a length of approximately three-quarters of an inch and a diameter of approximately seven-eights of an inch. In alternative embodiments, magnet 14 is other than a cylindrical member, for example a rectangular or U-shaped member. Magnetic responsive element 16, for example a steel member such as a steel bearing, is a substantially cylindrical member having a somewhat enlarged medial portion and narrowed end portions defining a substantially barrel-shaped configuration. The length of element 16 is approximately five-eights of an inch, the diameter at the medial portion is approximately three-eights of an inch and the diameters at each end portion is approximately five-sixteenths of an inch. In alternative embodiments, element 16 is other than barrel-shaped, for example cylindrical shaped. As hereinafter described element 16 is slidably received in channel 18.

Figure 5:
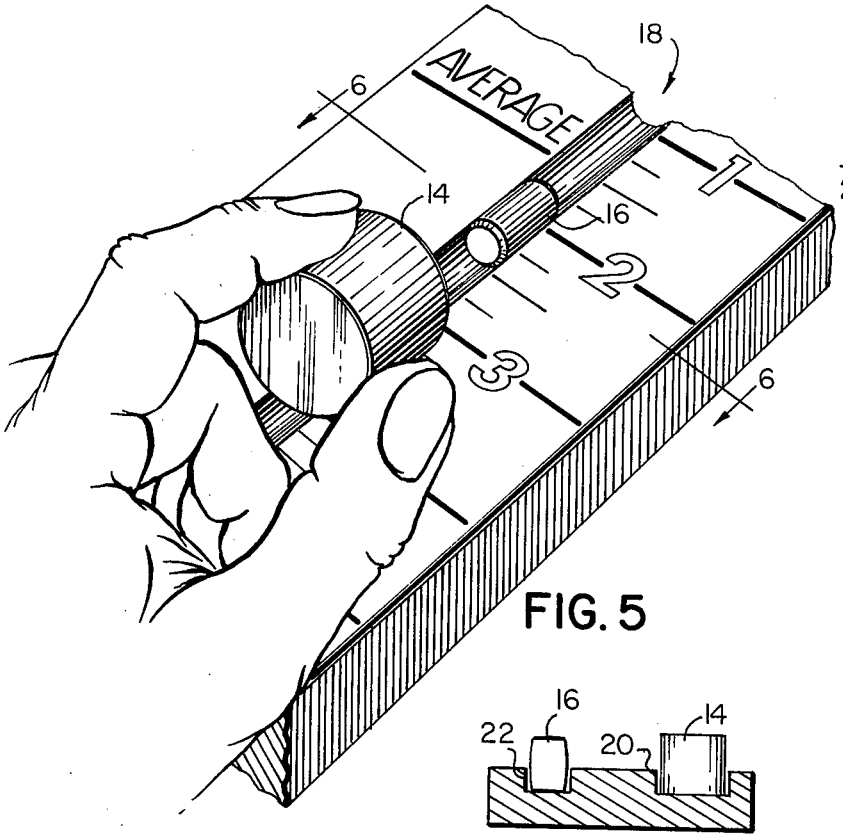
FIG. 5 is a perspective view illustrating use of the magnetic game device of FIG. 1.

As best shown in FIG. 1, board 12 is provided with indicia 24, which defines a graduated scale for determining a player's score. In the preferred embodiment, indicia 24 includes a numerical scale 26 and a character scale 28, the scale being disposed on opposite sides of channel 18. Scale 26, which extends longitudinally along channel 18, includes the numerals 1 through 12, the numeral one being closest to a starting line 28 near the top of the channel and the numeral 12 near the bottom of the channel. Scale 28, which extends longitudinally along channel 18 at a side opposite scale 26, includes descriptive words defining the expertise of a player. The object of magnetic game device 10, as illustrated in FIG. 5, is to move magnetically responsive element or playing piece 16 along channel 18 by means of magnet 14.

Figure 6:
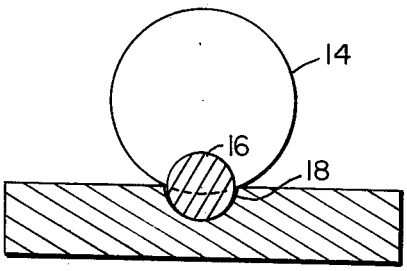
FIG. 6 is a cross-section taken along the lines 6—6 of FIG. 5.

In order to play game 10, first a player places playing piece 16 at starting line 28, which is approximately 1 inch from the end of board 12. Then, the player places magnet 14 in channel 18, a portion of the magnet 14 riding in the channel. That is, as shown in FIG. 6, a portion of magnet 14 is slidably received in channel 18, which defines a track for both the magnet and the playing piece, Next, the player maneuvers magnet 14 towards and away from playing piece 16 in order to move the playing piece in channel 18 towards the higher scale numbers. The attraction properties of magnet 14 on playing piece 16 is such that a skilled player can move the playing piece along channel 18. The surface finish of channel 18 is sufficiently rough to prevent frictionless movement of playing piece 16 and is sufficiently smooth to allow the attraction properties of magnet 14 to pull playing piece 16 along the channel. For example, when board 12 is composed of wood, a varnish coating is applied to channel 18. If magnet 14 is too far away from playing piece 16, the playing piece will not move. If magnet 14 is too close to playing piece 16, magnetic attraction will cause contact between the magnet and playing piece. A player's turn ends when playing piece 16 has been moved to the numeral 12 or the magnet and playing piece have contacted each other. The position of playing piece 16 relative to numerical scale 26, which is graduated in one-quarter of an inch increments, defines the player's score. In alternative embodiments, scale 26 is graduated in other than one-quarter of an inch increments, for example, one-half, one-eight, or one-sixteenth of an inch increments.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A magnetic game device for determining the skill of a player, said game device comprising:

a. a game board composed of a non-magnetic material, said game board formed with a channel; and b. a pair of magnetically cooperating playing pieces, one of said playing peices composed of a magnetized material, the other of said playing pieces composed of a magnetically responsive material, said playing pieces slidably received within said channel;

c. one of said playing pieces constrained for movement within said channel along a longitudinal axis thereof, said one playing piece moved along said channel by the player maneuvering the other of said playing pieces relative to said one playing piece while said playing pieces are disengaged, a portion of said one playing piece and a portion of said other playing piece disposed in a common, substantially horizontal plane.

2. The magnetic game device of claim 1 wherein said game board includes scoring indicia disposed along said channel, a player's score being indicated on said scoring indicia when said playing pieces are engaged.

3. The magnetic game device of claim 1 wherein said game board includes holders for said playing pieces.

4. The magnetic game device of claim 1 wherein one of said playing pieces is a magnet in the form of a cylinder and the other of said playing pieces is a steel bearing having a substantially cylindrical form.

5. The magnetic game device of claim 4 wherein the diameter of said magnet is approximately seven eights of an inch and the diameter of said steel bearing is approximately three eights of an inch.

6. A magnetic game device for determining the skill of a player, said game device comprising:

a. a game board composed of a non-magnetic material, said game board formed with a channel; and b. a pair of magnetically cooperating playing pieces, one of said playing pieces composed of a magnetized material, the other of said playing pieces composed of a magnetically responsive material, at least one of said playing pieces slidably received within said channel;

c. said playing piece within said channel being moved along said channel by the player maneuvering said other playing piece while said playing pieces are disengaged;

d. one of said playing pieces being a magnet in the form of a cylinder and the other of said playing pieces being a steel bearing having a substantially cylindrical form, the diameter of said magnet is approximately seven-eights of an inch and the diameter of said steel bearing is approximately three-eights of an inch;

e. said channel having a substantially semi-circular profile in right cross section, the diameter of which is approximately three-eights of an inch, said magnet and said steel bearing slidably received in said channel.

7. A magnetic game device for determining the skill of a player, said game device comprising:

a. a game board formed with a longitudinally extending U-shaped channel, said game board composed of a nonmagnetic material;

b. first and second magnetically cooperating playing pieces disposed in said channel in a common, substantially horizontal plane for engagement and disengagement with one another, one of said playing pieces composed of a magnetized material, the other of said playing pieces composed of a magnetically responsive material; and c. scoring indicia longitudinally disposed about said channel for indicating the player's score;

d. said first playing piece constrained for movement within said channel along a longitudinal axis thereof, said first playing piece moved along said channel by the player maneuvering said second playing piece relative to said first playing piece, the cooperative magnetic properties of said playing pieces being such that said second playing piece is operative to move said first playing piece along said channel while said playing pieces are disengaged, the player's score being indicated on said indicia when said playing piece are engaged.

8. The magnetic game board of claim 7 wherein said channel has a surface finish that is sufficiently rough to prevent frictionless movement of said first playing piece and is sufficiently smooth to allow the magnetic properties of said second playing piece to move said first playing piece along said channel while said playing pieces are disengaged.

9. The magentic game of claim 7 wherein said second playing piece is a magnet and said first playing piece is a steel bearing, each of said playing pieces having a substantially circular profile in right cross section, the diameter of said second playing piece being approximately twice the diameter of said first playing piece.

* * * * *